United States Patent [19]

Moore et al.

[11] Patent Number: 5,014,977

[45] Date of Patent: May 14, 1991

[54] SHEET STOPPING AND LATERAL REGISTRATION SYSTEM

[75] Inventors: Kenneth P. Moore, Rochester; Brian R. Ford, Walworth; Stephen B. Williams, Ontario, all of N.Y.

[73] Assignee: Xerox Corporation, Stamford, Conn.

[21] Appl. No.: 518,367

[22] Filed: May 3, 1990

[51] Int. Cl.[5] ..... B65H 31/36

[52] U.S. Cl. ..... 271/221; 271/236; 271/250; 271/225; 271/248

[58] Field of Search ..... 271/177, 178, 207, 220, 271/221, 224, 236, 250, 255, 184, 242, 225, 239, 245, 248

[56] References Cited

U.S. PATENT DOCUMENTS

| | | | |
|---|---|---|---|
| 3,669,447 | 6/1972 | Turner et al. | 271/53 |
| 4,029,309 | 6/1977 | Lynch et al. | 270/53 |
| 4,248,413 | 2/1981 | Fox | 270/53 |
| 4,552,351 | 11/1985 | Tsukamoto | 271/3.1 |
| 4,618,302 | 10/1986 | Kokubo et al. | 414/33 |
| 4,687,193 | 8/1987 | Scarabino et al. | 271/184 |
| 4,715,594 | 12/1987 | Isobe et al. | 271/65 |
| 4,724,945 | 2/1988 | Martin | 271/184 X |
| 4,778,170 | 10/1988 | Hynes | 271/253 |
| 4,903,956 | 2/1990 | Stephens et al. | 271/178 |

FOREIGN PATENT DOCUMENTS

| | | | |
|---|---|---|---|
| 0115541 | 9/1980 | Japan | 271/225 |
| 0109359 | 6/1983 | Japan | 271/221 |

OTHER PUBLICATIONS

XDJ-XEROX Disclosure Bulletin, vol. 8, No. 3, May/-June 1983.

*Primary Examiner*—H. Grant Skaggs
*Assistant Examiner*—C. Druzbick

[57] ABSTRACT

An integral sheet stopping, stacking and lateral registration system, in which sequential incoming sheets are fed into a tray and stopped at an edge registration position and also repositioned laterally by lateral sheet repositioning scuffers engaging an edge of the sheets at the edge registration position, with improved protection against sheet edge distortion or damage provided by movable partial sheet stopping surfaces partially shielding the incoming sheet lead edge from full impact with the lateral scuffers but without interfering with the subsequent lateral movement of the sheets by the lateral scuffers. The incoming sheets are fed in and stacked under a stack-floating curved input guide baffle and floating frictional input flapper scuffers feeding and holding an incoming sheet downstream against the lateral scuffers for improved lateral registration. The movable partial sheet stopping surfaces are mounted to ride vertically on the floating baffle and also ride horizontally against the lateral scuffers and thereby maintain a desired preset spacing relative thereto.

8 Claims, 4 Drawing Sheets

SHEET STOPPING AND LATERAL REGISTRATION SYSTEM

There is disclosed herein an improvement in sheet handling systems, and more particulary to a system and apparatus for improved sheet stopping with reduced sheet edge distortion. Further disclosed is an integral, dual mode, sheet stopping and stacking and lateral registration system. Additional features relate to the specific embodiment disclosed herein.

In particular, there is further disclosed a copier or printer duplex tray system with an improved system for intermediately stopping and stacking and laterally (transversely) re-aligning or re-registering sequentially inputted copy sheets.

The specific disclosed embodiment is an improvement over the duplex tray sheet stacking and lateral registration system of the Xerox Corporation "5090" "1090" and "1075" copiers or duplicators, in which simplexed copy sheets to be duplexed are fed at high speed into the stacking area of the duplex tray to impact against a spaced pair of cylindrical rubber "scuffer" rollers rotating about vertical axes in the rear of the tray. These vertical elastomeric rollers stop and deskew the sheets as their lead edges impact the rollers. However, an additional function of these rollers is that their "scuffer" rotation against the incoming leading edge of the sheets drives the sheets laterally toward one side edge or guide of the tray to provide lateral or transverse realignment of the sheets by contact between the side edge of the sheets and this tray side guide. Thus, for example, the "5090" copier duplex tray can stack and re-align for proper refeeding therefrom up to 250 sheets with this system. It also includes several "kickers", and flexible deflectors, to help knock down and hold down the incoming sheets trail edges and resist sheets from "floating" from residual air flow from the bottom feeder. This prior duplex tray scuffer rollers system is generally shown in Xerox Corporation U.S. Pat. No. 4,778,170 issued Oct. 18, 1988 to Frank R. Hynes. Another example of a proposed such restacking sheet stopping and lateral registration system, in another application, is shown in Xerox Corporation U.S. Pat. No. 4,248,413, but it is using a single laterally moving belt flight instead of two vertical rollers for lateral sheet registration.

By way of background, the general nature and function of such a duplex tray in the overall scheme of an exemplary duplexing copier or printer as shown for example in FIG. 1 here, is disclosed for example in Xerox Corporation U.S. Pat. No. 4,782,363 to Britt et al, U.S. Pat. No. 4,278,344 to Sahay, U.S. Pat. No. 4,330,197 to Smith et al, etc., and need not be further described herein. In any case, the present invention is not limited to that particular application, utility or embodiment.

Although, as will be described, the present system can be used to overcome a serious problem in second side image deletions in duplexing, it also has utility in finisher compilers, output stackers, sorter or collator trays, and other applications in which rapidly moving paper or other delicate sheets must be rapidly stopped without damage in a correct and consistent alignment and position. The present system has the ability to provide stacking of sheets with high levels of curl.

Also as to specific hardware components of the subject apparatus, it will be appreciated that, as is normally the case, various of such specific hardware components, such as the illustrated resilient flappers, are known per se in other apparatus or applications, including that described in art cited herein, and need not be re-described herein. Examples of patents on rotary driven resilient flappers for sheet feeding or stacking, including lateral registration, are Xerox Corporation U.S. Pat. Nos. 3,671,094, 3,669,447 and 4,029,309. Another resilient scuffer drive (angled for side registration delivery of single sheets) associated with a curved baffle is shown in Xerox Disclosure Journal Vol. 8, No. 3, May/June 1983, p. 255–7, to John H. Looney. Other paddle wheel flapper type sheet feeders are disclosed in U.S. Pat. Nos. 4,687,193; 4,618,302; 4,715,594; 4,903,956; and 4,552,351.

As noted in the prior art, as xerographic and other copiers and printers increase in speed, and become more automatic, it is increasingly important to provide higher speed yet more reliable and more automatic handling of the sheets being handled and copied. It is desirable to reliably feed and accurately register for copying sheets of a variety or mixture of sizes, types, weights, materials, conditions and susceptibility to damage. Furthermore, the images on the sheets and/or their fusing can change the sheet feeding characteristics. The sheets may be subject to damage in feeding if not properly handled. Numerous prior art references point out the undesirability and disadvantages of using hard fixed gate or stop finger registration systems into which a document is driven or impacted.

In particular, it has been found that edge buckles, dents or puckers formed in the edge of a sheet in handling that sheet in the printing of one side thereof can interfere with proper printing or image transfer on that area of the sheet on the opposite side thereof. Specifically, the high speed impact of the edge of the sheet against even a resilient stop such as the rubber scuffer rollers in the duplex tray has been discovered to be a source of such copy quality duplexing defects.

Another particular problem with copier or printer duplex tray sheet restacking is the fact that the sheets may be substantially curled by the copiers roll fusing process in the first pass of the sheets through the copier just before reaching the duplex tray. The present system provides improved restacking control for such curled sheets.

In the present system, these specific problems of duplex tray sheet restacking have been overcome with the disclosed cooperative combination of movable sheet stopping surfaces riding on and partially shielding the sheet lead edges from impact with the lateral scuffers, by partially absorbing that impact over a much larger area, but not preventing the subsequent lateral movement of the sheets by the rotating scuffers, which sheet stopping surfaces are movably mounted on an overlying stack-floating curved input guide baffle, which floating baffle is also carrying floating flappers or the like to maintain in the proper position, irrespective of stack height or sheet curl, a sufficient sheet engagement force for a sufficient time between the last-stacked top sheet and these lateral scuffers to provide reliable lateral sheet registration.

Further by way of background, as noted in the prior art, one of the most difficult to achieve features for automatic sheet handling is the rapid, accurate, reliable, and safe registration of each sheet at the proper position for copying or finishing. Conventionally the sheet is desirably either center-registered or corner-registered (depending on the copier) automatically at a preset registration position relative to the copier sheet path at which the sheet is properly aligned with the copier for correct imaging. This registration accuracy is desirably consistently within approximately one millimeter or less. If not properly registered, then undesirable dark borders and/or edge shadow images may appear on the ensuing printed copy sheet, or information near an edge of the original document may be lost, i.e. not copied onto the copy sheet. Misregistration, especially skewing, can also adversely affect further feeding and/or restacking. Thus, integral side or lateral registration and side edge deskewing is known to be highly desirable.

In the description herein the term "sheet" refers to a usually flimsy sheet of paper, plastic, or other such conventional individual image substrate, and not to microfilm or electronic images which are generally much easier to manipulate. The "document" is the sheet (original or previous copy) being imaged, or copied in the copier onto the "copy sheet", which may be abbreviated as the "copy". Related, e.g., page order, plural sheets are referred to as a "set". A "simplex" document or copy sheet is one having its image and page number on only one side or face of the sheet, whereas a "duplex" document or copy sheet has "pages", and normally images, on both sides, i.e., each duplex document and copy sheet is considered to have two opposing sides, faces, or "pages" even though no physical page number may be present.

A specific feature of the specific embodiment disclosed herein is to provide a sheet handling apparatus for providing an integral sheet stopping, stacking and lateral registration system, in which sequential incoming flimsy sheets of paper or the like are fed in a first direction of movement into a sheet supporting area by sheet input means and intermediately stopped at an edge registration position, and in which said sheets are also repositioned laterally by sheet lateral repositioning means in a transverse secondary direction of movement, which sheet lateral repositioning means engage the edges of sheets at said edge registration position, an improvement therein with improved protection against sheet edge distortion or damage, comprising movable sheet stopping means with partial sheet stopping surfaces partially shielding the incoming sheet lead edge from full engagement with said sheet lateral repositioning means by partially engaging the same sheet edge, but not preventing the lateral movement of the sheet by said sheet lateral repositioning means.

Further specific features provided by the system disclosed herein, individually or in combination, include those wherein said sheet lateral repositioning means comprises rotatable frictional scuffer means for engaging the edges of sheets at said stacking edge registration position, and wherein said partial sheet stopping surfaces of said movable sheet stopping means engages the same edge of an incoming sheet over a much larger area than said rotatable frictional scuffer means to protect against sheet edge distortion or damage by the initial impact of the incoming sheet edge with the scuffer means but without interfering with the subsequent lateral movement of the sheets by the scuffer means, and/or wherein said incoming sheets are stacked on top of previous inputted sheets in said sheet supporting area, and wherein said sheet input means comprises an overlying stack-floating curved input guide baffle and cooperating frictional sheet feeding means for feeding and holding an incoming sheet edge against said sheet lateral repositioning means, and/or wherein said incoming sheets are stacked on top of previous inputted sheets in said sheet supporting area, and said movable sheet stopping means includes stack-floating means for maintaining said movable sheet stopping means relative to the top sheet of the stack, and said movable sheet stopping means further includes means for riding against and thereby maintaining a preset spacing relative to said sheet lateral repositioning means, and wherein said frictional sheet feeding means comprises rotatably driven flapper means mounted to float together with said stack-floating curved input guide baffle in response to stack height and to frictionally feed an incoming sheet primarily in said first direction of movement but also in said transverse secondary direction of movement, and or wherein said frictional sheet feeding means is automatically maintained in a stack-floating position, irrespective of stack height or sheet curl, in which it is providing a sufficient top sheet engagement force for a sufficient time on the last-stacked top sheet towards said sheet lateral repositioning means to provide reliable lateral sheet registration thereby, wherein said sheet supporting area is a duplex tray of a duplexing copier or printer and said sequential incoming flimsy sheets of paper or the like are copy sheets thereof which have been printed on one side and are being laterally re-registered by said lateral repositioning means in said duplex tray before being printed on their opposite sides to make duplex copies, and/or wherein said sheet lateral repositioning means comprises rotatable frictional lateral scuffer means rotatably driven about a generally vertical axis for engaging the edges of sheets at said stacking edge registration position, and wherein said partial sheet stopping surfaces of said movable sheet stopping means engages the same edge of an incoming sheet over a much larger area than said rotatable frictional lateral scuffer means to protect against sheet edge distortion or damage by the initial impact of the incoming sheet edge with the scuffer means but without interfering with the subsequent lateral movement of the sheets by the lateral scuffer means, and wherein downstream top scuffers are mounted relative to an overlying stack-floating input guide baffle to be maintained in a proper position, irrespective of sheet stack height or sheet curl, to provide sufficient sheet engagement force for a sufficient time between the last-stacked top sheet and said lateral scuffer means to provide reliable lateral sheet registration.

The disclosed apparatus may be readily operated and controlled in a conventional manner with conventional control systems. Some additional examples of control systems for various prior art copiers with document handlers, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general, and preferable, to program and execute such control functions and logic with conventional software instructions for conventional microprocessors. This is taught by the above and other patents and various commercial copiers. Such software will of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively by provided utilizing various other known or suitable hard-wired logic or switching systems. As shown in the above-cited art, the control of exemplary document and copy sheet handling systems in copiers may be accomplished by conventionally actuating them by signals from the copier controller directly or indirectly in response to simple programmed commands and from selected actuation or non-actuation of conventional copier switch inputs by the copier operator, such as switches selecting the number of copies to be made in that run, selecting simplex or duplex copying, selecting whether the documents are simplex or duplex, selecting a copy sheet supply tray, etc. The resultant controller signals may conventionally actuate various conventional electrical solenoid or cam-controlled sheet deflector fingers, motors or clutches in the copier in the selected steps or sequences as programmed. Conventional sheet path sensors, switches and bail bars, connected to the controller, may be utilized for sensing and timing the positions of documents and copy sheets, as is well known in the art, and taught in the above and other patents and products. Known copying systems utilize such conventional microprocessor control circuitry with such connecting switches and sensors for counting and comparing the numbers of documents and copy sheets as they are fed and circulated, keeping track of their positions, counting the number of completed document set circulations and completed copies, etc., and thereby controlling the operation of the document and copy sheet feeders and inverters, etc.

All references cited in this specification, and their references, are incorporated by reference herein where appropriate for appropriate teachings of additional or alternative details, features, and/or technical background. Various of the above-mentioned and further features and advantages will be apparent from the specific apparatus and its operation described in the example below, as well as the claims. Thus the present invention will be better understood from this description of this embodiment thereof, including the drawing figures (approximately to scale) wherein:

FIG. 1 schematically shows an otherwise known duplexing copier in which the system of the invention is schematically shown as part of the duplex buffer tray.

Figure 1:
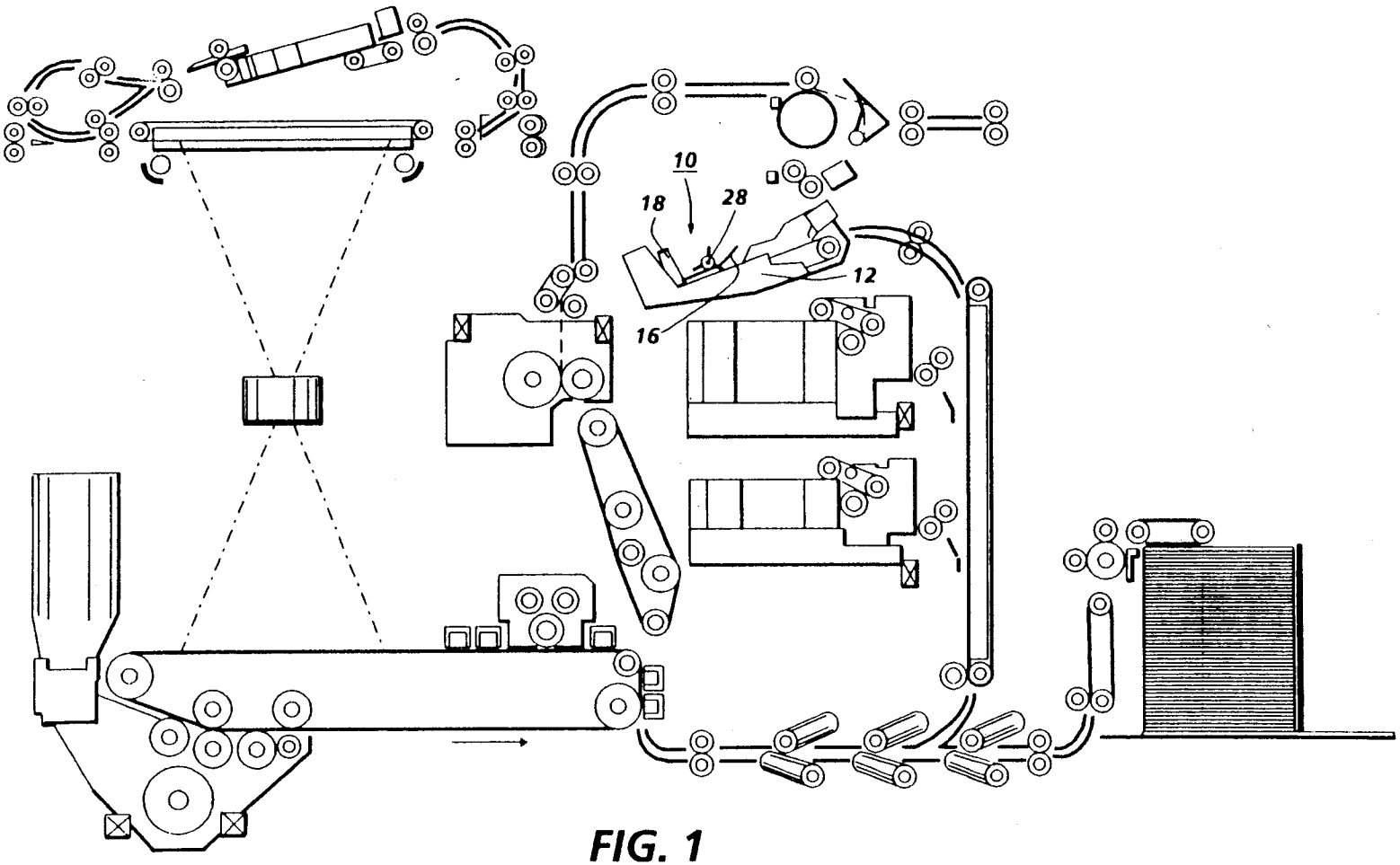
Figure 2:
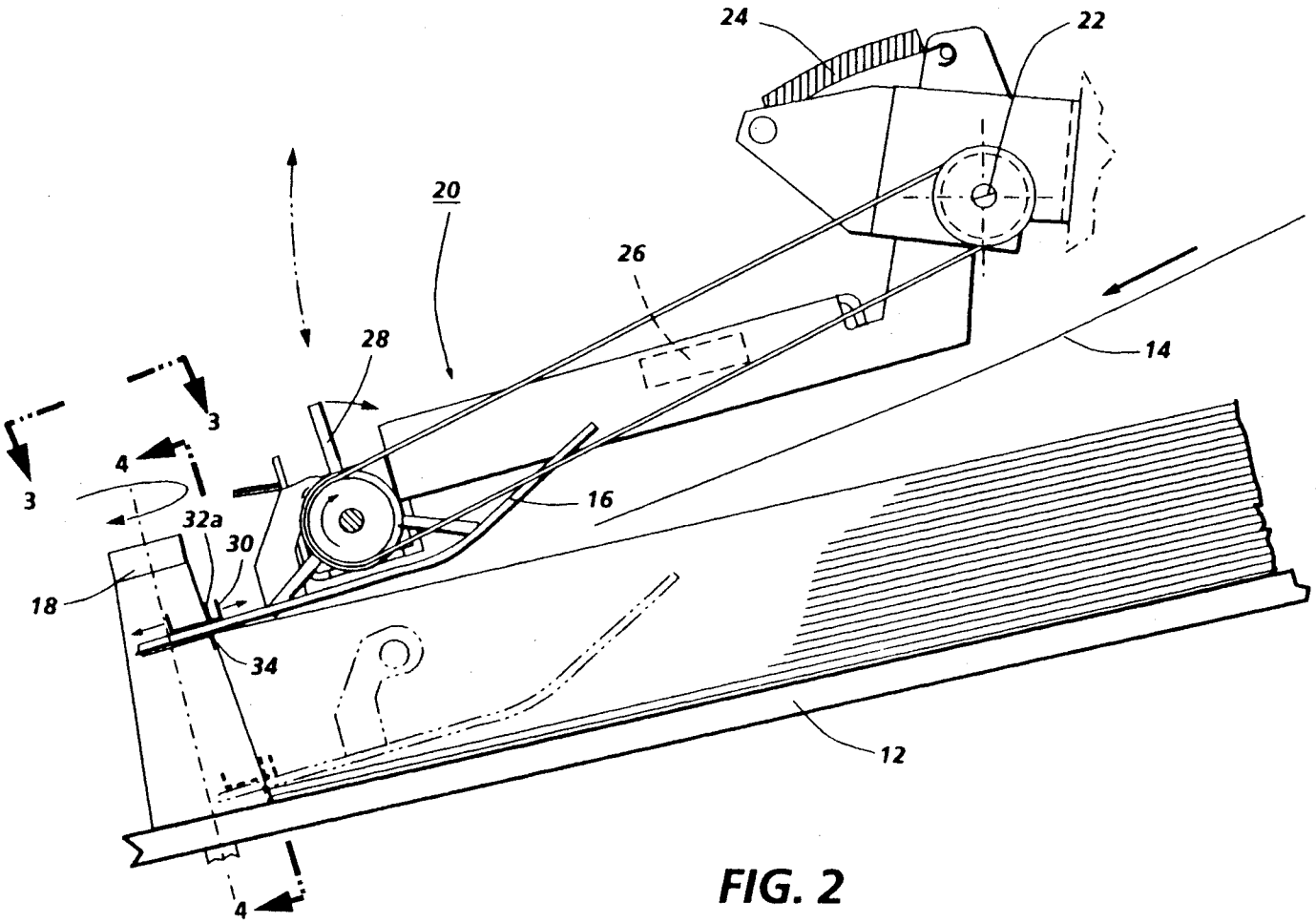
FIG. 2 is a side view of one embodiment of the sheet stopping and registering system of the invention.

Describing now in further detail the exemplary embodiment with reference to the Figures, there is shown one example of a sheet stacking and lateral registration system 10 in accordance with the invention. The system 10 is here shown as part of a duplex tray unit 12 for stacking and laterally registering sheets 14 sequentially entering (fed into) the tray 12 as shown in FIG. 2. The entering sheet 14 is fed under a large downwardly curving baffle plate 16. The forward end of the baffle plate 16 converges towards and floats on the top of the stack of sheets in the tray 12. This is illustrated in FIG. 2 by the phantom line position of the baffle plate 16 for a smaller stack.

Figure 3:
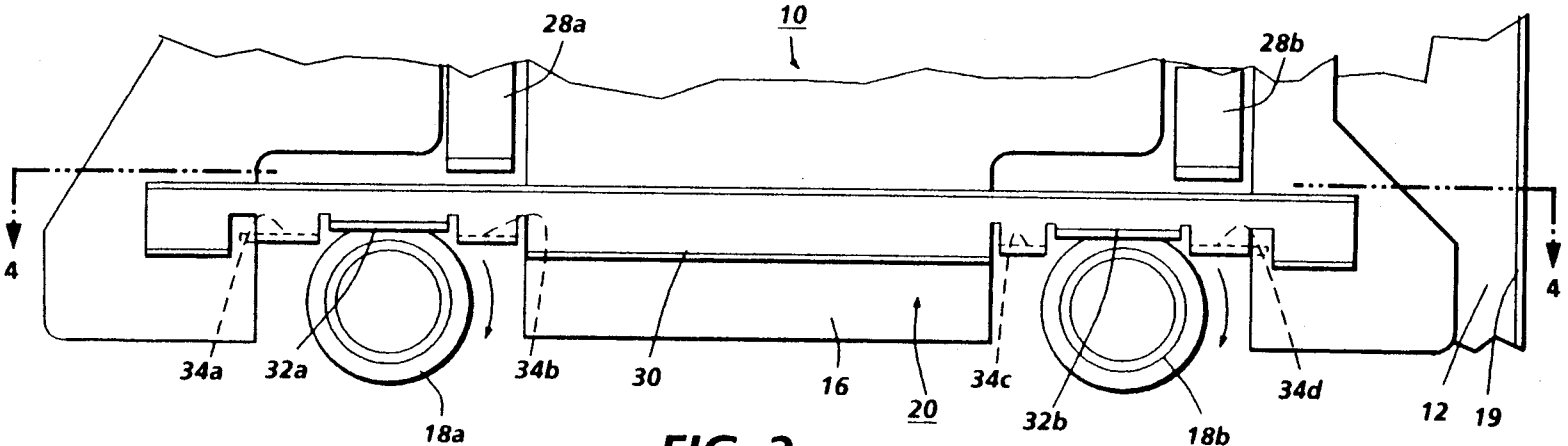
FIG. 3 is a partial top view, a view taken along line 3—3 of FIG. 2.
Figure 4:
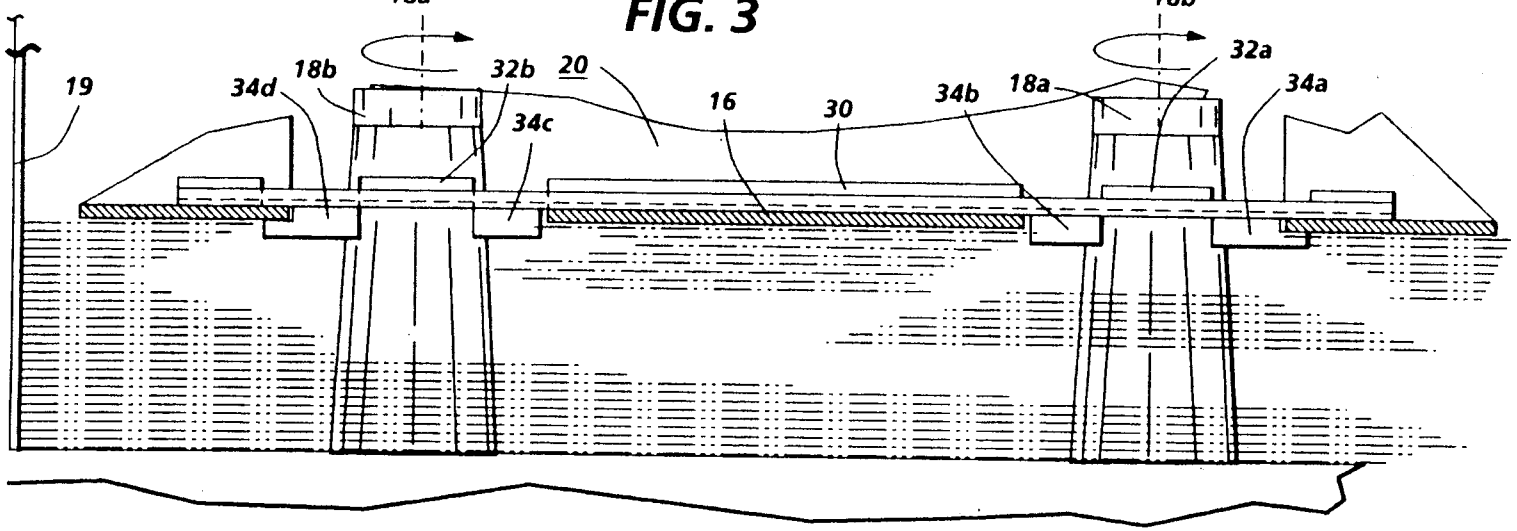
FIG. 4 is an cross-sectional plan view taken along the lines 3—3 of FIG. 2 and FIG. 3.
Figure 5:
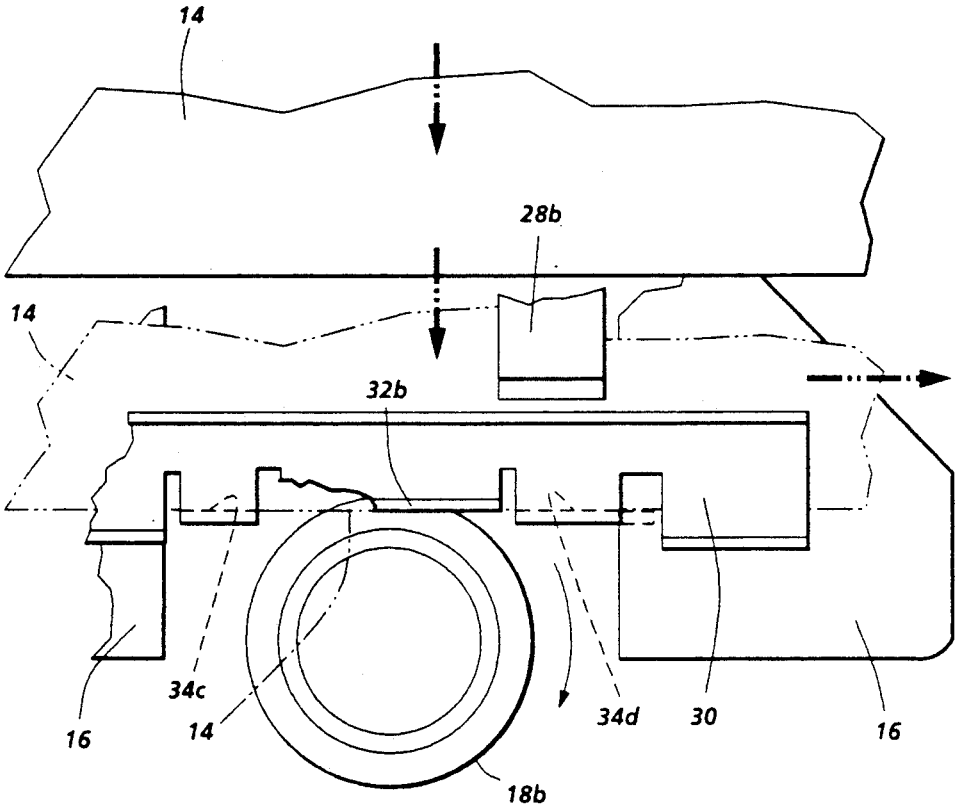
FIG. 5 is an enlarged portion of the FIG. 3 partial top view additionally showing a portion of a sheet being stopped and laterally registered.

At the downstream end of the tray 12, as noted above, and particularly well shown in FIG. 5, the lead edge of the incoming sheet 14 impacts a spaced pair of resilient material scuffers 18*a* and 18*b*. Both scuffers 18 are rotatably driven about generally vertical axes perpendicular the tray bottom surface so that the surfaces of the scuffers 18 facing the lead edges of the sheets 14 move them towards one side wall 19 of the tray 12, as shown in FIGS. 3 and 5. The scuffers 18 are generally cylindrical but slightly upwardly conically tapered to provide for wear compensation, and enable fitting into allocated space.

The baffle plate 16 is part of an integral floating arm unit 20 pivotable about an axis of rotation 22, with a partial counterbalance. Although flexator springs 24 and a balance adjust weight 26 are shown as one example, the partial counterbalance may be provided by an overcenter counterweight on the opposite side of axis 22, instead of using flexator springs 24. As noted, the forward end of the baffle plate 16, and thus the entire integral floating arm unit 20, floats on the top of the stack of sheets in the tray 12.

Also mounted on and carried by the integral floating arm unit 20 are two resilient rotating flapper drive units 28*a* and 28*b* for continuously scuffing forward (downstream) towards the respectively associated scuffers 18*a* and 18*b* the sheet 14 being stacked on top of the stack. These exemplary three-paddle or three-flapper paddlewheels also overcome any drag resistance of the sheet against the baffle 16. As the arm unit 20 adjusts automatically to the stack height the spacing of the ends of flappers is automatically maintained at the same desired distance from the top of the stack.

Optionally, the inboard paddlewheel's flappers may be slightly narrower and therefore have a slightly weaker driving force. Also preferably the paddles or flappers of both units 28*a* and 28*b* are molded at a slight angle to their shafts to provide a lateral force component on the sheet, known per se, for assistance in the lateral sheet registration without requiring angled drive shafts. Flappers with larger angles may be used for copiers with incoming paper farther inboard needing faster side registration.

Also mounted on and carried by the integral floating arm unit 20 is a channel member 30 extending transversely across the tray and sheet path. The channel member 30 is slideably mounted on top of the downstream end area of the baffle plate 16. The vertical position of the channel member 30 is determined by the supporting baffle plate 16 end which, since it floats on the stack top there, maintains the vertical position of the channel member 30 just above the stack top. However, the slideable mounting allows the alignment of the channel member 30 in the sheet feeding direction to be controlled by engagement of vertically extended tab riding surfaces 32*a* and 32*b* thereon with the scuffers 18*a* and 18*b*, respectively. Thus any runout or wear there in the rotation of the scuffers 18 is automatically compensated for. The channel member 30 in effect "floats" on, and is aligned with, the front (sheet engaging), tangential surfaces of the two scuffers 18*a* and 18*b*.

Extending downwardly into the sheet path from the same channel member 30 are four separate integral tabs, respectively forming generally vertical sheet stopping or impacting surfaces 34*a*, 34*b*, 34*c* and 34*d*. As noted, they are thus movable with and aligned with both the scuffers 18 and the particular stack height. They provide sheet stopping surfaces partially shielding the sheet lead edge from impact with the lateral scuffers 18, by partially absorbing that impact over a much larger and planar area thereof, but not preventing the subsequent lateral movement of the sheets by the rotating scuffers 18. To this end the sheet stopping or impacting surfaces 34*a*, 34*b*, 34*c* and 34*d* are formed spaced slightly downsteam of the scuffer-riding surfaces 32*a* and 32*b* of the same channel member 30 so that the surfaces 34*a*, 34*b*, 34*c* and 34*d* are slightly downstream of, and partially extending behind or in back of, the front surfaces of the two scuffers 18*a* and 18*b*. As also shown, the stopping surfaces 34*a*, 34*b*, are protecting or partially shielding (by extending from opposite sides of) scuffer 18*a*, and surfaces 34*c* and 34*d* are partially shielding scuffer 18*b*. The depth of contact with a sheet lead edge and a scuffer 18 is thus precisely limited, thereby preventing excessive sheet edge area deformation by impact with the scuffers 18. Yet sufficient engagement therewith for lateral movement for lateral sheet registration is provided by the flapper drive units 28.

The stopping surfaces 34*a*, 34*b* allow the sheet to be positively driven by the flapper drive units 28*a* and 28*b* against the lateral scuffers 18, and pressed thereagainst, yet not be damaged by being overdriven thereagainst, thus allowing fast positive infeeding and lateral registration yet protecting against sheet edge damage, and protecting against sheet edge curls or cockles which could inhibit second side image transfer.

The stopping surfaces or fingers 34*c*, 34*d* are preferably short, as shown. These stopping surfaces 34*a*, 34*b* need only extend down far enough to ensure protection of the incoming and topmost sheet of the stack which is exposed to the flapper drive units 28*a* and 28*b* driving force. This also allows the edges of sheets of the rest of the stack to fully contact the scuffers 18 to insure continued stack registration as the stack builds up.

In the system 10, specific problems of duplex tray 12 sheet restacking even with curled sheets and large stacks have been overcome with the disclosed cooperative combination of movable sheet stopping surfaces 34 partially shielding the sheet lead edges from impact with the lateral scuffers, by partially absorbing that impact over a much larger area, but not preventing the subsequent lateral movement of the sheets by the rotating scuffers, which sheet stopping surfaces 34 are movably mounted on an overlying stack-floating curved input guide baffle 16, and flappers or the like downsteam scuffers also maintained in the proper position, irrespective of stack height or sheet curl, providing sufficient sheet engagement force for a sufficient time between the last-stacked top sheet and these lateral scuffers to provide reliable lateral sheet registration.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In sheet handling apparatus for providing an integral sheet stopping, stacking and lateral registration system, in which sequential incoming flimsy sheets of paper or the like are fed in a first direction of movement into a sheet supporting area by sheet input means and intermediately stopped at an edge registration position, and in which said sheets are also repositioned laterally by sheet lateral repositioning means in a transverse secondary direction of movement, which sheet lateral repositioning means engage the edges of sheets at said edge registration position, an improvement therein with improved protection against sheet edge distortion or damage, comprising movable sheet stopping means with partial sheet stopping surfaces partially shielding the incoming sheet lead edge from full engagement with said sheet lateral repositioning means by partially engaging the same sheet edge, but not preventing the lateral movement of the sheet by said sheet lateral repositioning means.

2. The sheet handling apparatus of claim 1, wherein said sheet lateral repositioning means comprises rotatable frictional scuffer means for engaging the edges of sheets at said stacking edge registration position, and wherein said partial sheet stopping surfaces of said movable sheet stopping means engages the same edge of an incoming sheet over a much larger area than said rotatable frictional scuffer means to protect against sheet edge distortion or damage by the initial impact of the incoming sheet edge with the scuffer means but without interfering with the subsequent lateral movement of the sheets by the scuffer means.

3. The sheet handling apparatus of claim 1, wherein said incoming sheets are stacked on top of previous inputted sheets in said sheet supporting area, and said movable sheet stopping means includes stack-floating means for maintaining said movable sheet stopping means relative to the top sheet of the stack, and said movable sheet stopping means further includes means for riding against and thereby maintaining a preset spacing relative to said sheet lateral repositioning means.

4. The sheet handling apparatus of claim 1, wherein said sheet supporting area is a duplex tray of a duplexing copier or printer and said sequential incoming flimsy sheets of paper or the like are copy sheets thereof which have been printed on one side and are being laterally re-registered by said lateral repositioning means in said duplex tray before being printed on their opposite sides to make duplex copies.

5. The sheet handling apparatus of claim 1, wherein said incoming sheets are stacked on top of previous inputted sheets in said sheet supporting area, and wherein said sheet input means comprises an overlying stack-floating curved input guide baffle and cooperating frictional sheet feeding means for feeding and holding an incoming sheet edge against said sheet lateral repositioning means.

6. The sheet handling apparatus of claim 5, wherein said frictional sheet feeding means comprises rotatably driven flapper means mounted to float together with said stack-floating curved input guide baffle in response to stack height and to frictionally feed an incoming sheet primarily in said first direction of movement but also in said transverse secondary direction of movement.

7. The sheet handling apparatus of claim 5, wherein said frictional sheet feeding means is automatically maintained in a stack-floating position, irrespective of stack height or sheet curl, in which it is providing a sufficient top sheet engagement force for a sufficient time on the last-stacked top sheet towards said sheet lateral repositioning means to provide reliable lateral sheet registration thereby.

8. The sheet handling apparatus of claim 4, wherein said sheet lateral repositioning means comprises rotatable frictional lateral scuffer means rotatably driven about generally vertical axis for engaging the edges of sheets at said stacking edge registration position, and wherein said partial sheet stopping surfaces of said movable sheet stopping means engages the same edge of an incoming sheet over a much larger area than said rotatable frictional lateral scuffer means to protect against sheet edge distortion or damage by the initial impact of the incoming sheet edge with the scuffer means but without interfering with the subsequent lateral movement of the sheets by the lateral scuffer means, and wherein downsteam top scuffers are mounted relative to an overlying stack-floating input guide baffle to be maintained in a proper position, irrespective of sheet stack height or sheet curl, to provide sufficient sheet engagement force for a sufficient time between the last-stacked top sheet and said lateral scuffer means to provide reliable lateral sheet registration.

* * * * *